United States Patent [19]

Ohlson

[11] 3,954,183

[45] May 4, 1976

[54] WALL ELEMENT AND AN ELEMENT FASTENING DEVICE

[76] Inventor: Kurt Lennart Ohlson, Moravagen 27, 161 40 Bromma, Sweden

[22] Filed: Jan. 4, 1974

[21] Appl. No.: 430,780

[52] U.S. Cl. ..... 211/186; 160/351; 211/183; 297/440

[51] Int. Cl.[2] ..... A47F 5/00

[58] Field of Search .....5/353.1–353.8; 52/406; 211/148, 177, 183; 297/218, 416, 440, 452; 160/351

[56] References Cited

UNITED STATES PATENTS

| | | | |
|---|---|---|---|
| 1,427,249 | 8/1922 | Weston | 211/177 X |
| 2,086,640 | 7/1937 | Reynolds | 297/218 |
| 3,038,758 | 6/1962 | Molla | 297/440 X |
| 3,704,911 | 12/1972 | Milakovich | 297/440 |
| 3,713,474 | 1/1973 | Orlando | 160/351 |
| 3,758,159 | 9/1973 | Morris | 5/353.2 X |
| 3,766,863 | 10/1973 | Swick et al. | 211/148 |

*Primary Examiner*—James T. McCall
*Assistant Examiner*—Lawrence J. Staab
*Attorney, Agent, or Firm*—Burns, Doane, Swecker & Mathis

[57] ABSTRACT

The invention relates to wall elements and preferably to such elements intended for use in the construction of office landscapes, bookshelves and the like. Wall elements intended for this purpose are provided with a stiffening frame structure to which is applied a casing forming the outer surface of the wall element. The fastening means intended for the wall element are securely connected to the reinforcing frame and arranged to extend from the frame through a distance such that the free end of the fastening means is at least located in a plane with the casing and preferably extends slightly beyond said casing.

The present invention also relates to an element fastening device, where the element has one or more retaining means in the form of a peg provided with a narrow web portion located at a distance from the free end of the peg. The device has at least two portions which are capable of being moved towards and away from each other by means of a screw or the like, at least one portion having a recess arranged to extend beyond the free end of the peg and is bent towards the narrow web thereof. The device upon actuation of the screw is arranged to be brought to a position in which said portions are brought together for co-action with the peg.

3 Claims, 16 Drawing Figures

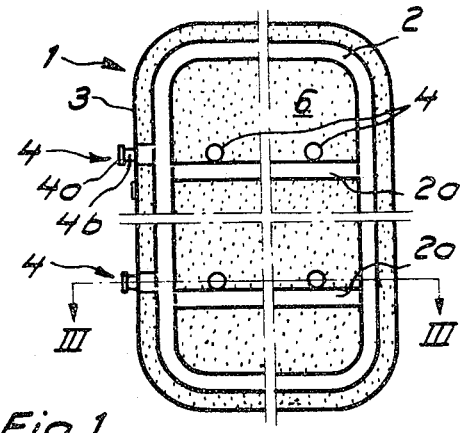
Fig.1
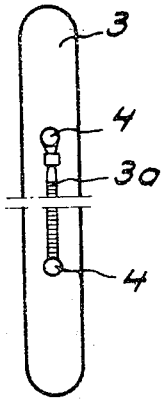
Fig.2
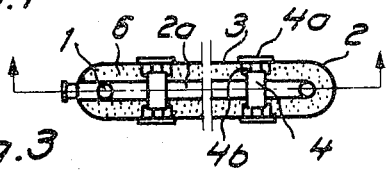
Fig.3
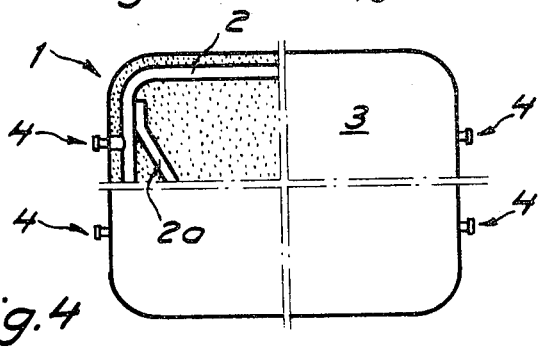
Fig.4
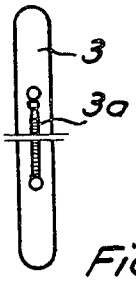
Fig.5
Fig.6
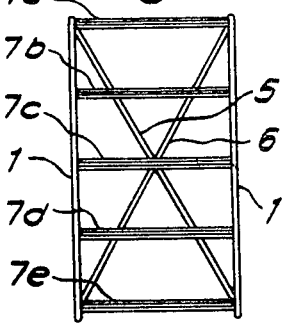
Fig.7
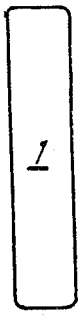
Fig.9
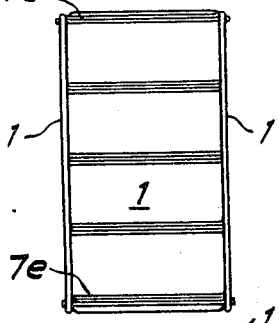
Fig.10
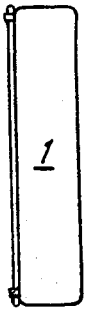
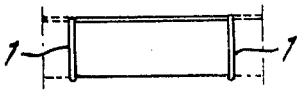
Fig.8
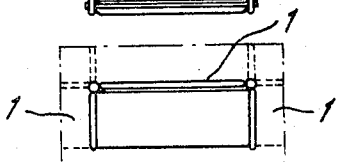
Fig.11

WALL ELEMENT AND AN ELEMENT FASTENING DEVICE

FIELD OF THE INVENTION

The present invention relates to wall elements and preferably to such elements intended for use in the construction of office landscapes, bookshelves and the like. Elements intended for this purpose are normally provided with a stiffening frame structure to which is applied a casing or outer skin forming the outer surface of the element. Such element is called "wall element" in the description which follows.

The present invention also relates to an element fastening device intended for fastening elements of the type having one or more retaining means in the form of a peg provided with a narrow web portion located at a distance from the free end of the peg.

DESCRIPTION OF THE PRIOR ART

Different types of wall elements which can be used to advantage for building office landscapes are known to the art. It is a prime desire with such wall elements, however, that fastening means intended for the wall elements shall be so constructed that the wall element can be firmly secured to an upright or the like and so that said fastening means are hidden from view to the greatest extent possible and do not deleteriously affect the use of the wall element in such a manner that remedial measures must be taken against said fasting means.

Different types of element fastening means are known to the art, and the element fastening device of the present invention is primarily intended for use with such elements as wall sections, book case sections and the like, and is designed to satisfy the desire of being able to join together two, normally identical elements by means of fastening means.

OBJECT OF THE PRESENT INVENTION

The object of the invention is to provide a wall element which fulfils the aforementioned requirements. This object is achieved with the wall element of the present invention, which is mainly characterized in that fastening means intended for the wall element are securely connected to the aforementioned reinforcing frame and arranged to extend from the frame through a distance such that the free end of the fastening means is at least located in the plane with the casing and preferably extends slightly beyond said casing.

The element fastening device of the present invention can be used to advantage with wall sections intended for use in building office landscapes and the like. The element fastening device may also be used with elements in the form of the side members for book cases where said sides are intended to co-act with each other or with a bookshelf.

Thus, the fastening device of the present invention provides a simple means for fastening elements of the aforementioned type and is mainly characterized in that said device has at least two portions which are capable of being moved towards and away from each other by means of a screw or the like, that at least one portion has a recess arranged to extend beyond the free end of a peg and is bent towards the narrow neck portion thereof, and that the device, upon actuation of the screw, is arranged to be brought to a position in which said portions are brought together for co-action with the peg.

BRIEF DESCRIPTION OF THE DRAWINGS

The invention will now be described in more detail with reference to a number of embodiments thereof illustrated in the accompanying drawings. Further features of the invention will become apparent to those skilled in the art in connection therewith. In the drawings:

FIG. 1 is a sectional front elevation of a first embodiment of a wall element constructed in accordance with the invention, FIG. 2 is a side elevation of the wall element in FIG. 1, FIG. 3 is a plan sectional view of the wall element shown in FIG. 1 viewed along the line III—III, FIG. 4 is a partial sectional front elevation of a second embodiment of a wall element, FIG. 5 is a side elevation of the wall element shown in FIG. 4, FIG. 6 is a front view of a book case constructed of the wall elements shown in FIGS. 1–3, FIG. 7 is a side view of the bookcase shown in FIG. 6, FIG. 8 is a plan view of the bookcase shown in FIG. 6, FIG. 9 shows a front view of a bookcase constructed of wall elements shown in FIG. 4, FIG. 10 is a side view of the bookcase shown in FIG. 9, FIG. 11 is a plan view of the bookcase shown in FIG. 9.

DESCRIPTION OF THE PREFERRED EMBODIMENTS

Figure 13:
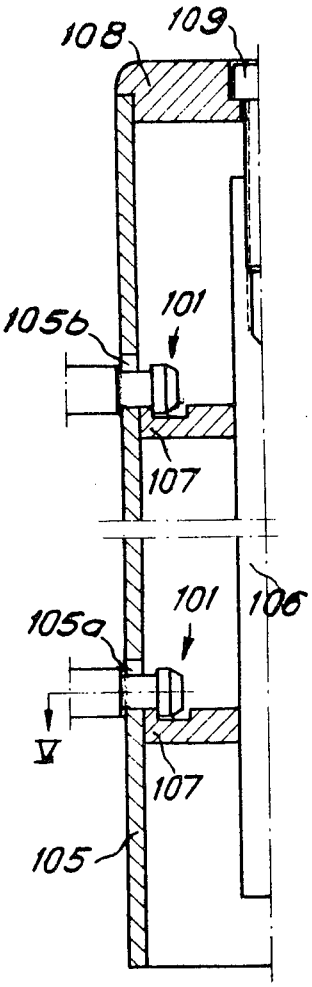
FIG. 13 shows a sectional side view of a further development of the inventive concept illustrated in FIG. 12, with the element inserted in the element fastening device.

Referring to FIG. 1, there is seen a wall element preferably intended for office landscapes, bookcases and the like. The wall element 1 has a reinforcing frame 2 to which is applied the casing 3 forming the outer surface of said element. Wall element fastening means 4 are securely connected to the frame 2 as by welding or the like. The fastening means 4 extend from the frame 2 to an extent such that the free end **4*a* of the fastening means 4 is at least located in plane with the casing 3 but preferably extends slightly beyond said casing. The latter is illustrated in FIG. 1. The fastening means 4 has a free end 4*a* and a neck portion 4*b* formed between said free end 4*a* and the frame 2. The neck portion is narrower than the free end 4*a***.

In accordance with one feature of the invention, a sound insulating layer 6, preferably formed from a plastic or similar material, is arranged around frame 2. The wall element 1 also has transverse frame portions **2*a* on which additional fastening means 4 are mounted. The additional fastening means also extend to the plane of the casing 3, whereby the free ends 4*a* of the fastening means 4 are located in the same plane as the front of said casing. As with the first mentioned fastening means, the latter fastening means also have a neck portion 4***b*. The casing 3 can now be pressed against the frame portion 2*a* through the insulating material 6 to expose the free end 4*a* of the fastening means, 4, thereby enabling the fastening means to co-act with the shelf of a bookcase for example. It will be understood that the casing 3 must be provided with the holes necessary for the fastening means 4 to pass through.

As will be seen from FIG. 1, the fastening means 4 are applied along at least one edge of the wall element.

In accordance with one aspect of the present invention, the casing 3 of the wall element 1, includes to advantage, a detachable and replaceable protective casing. To this end the casing is provided with a zip faster 3*a* or like device arranged between two fastening means 4. This is best seen from FIG. 2.

The protective casing 3 may, itself, support sound insulating sections capable of being adjusted around the frame 2, 2*a*, alternatively the sound insulating sections may comprise separate portions.

Referring to FIGS. 4 and 5, there is illustrated an alternative wall construction in which the frame portion 2 which is divided by a frame portion 2*a* extending from the upper left corner as seen in FIG. 4 down towards the centre portion of the wall element. A corresponding portion not shown extends from the lower centre portion of the wall element up towards the right hand corner. The wall element of FIG. 4 is provided with a plurality of fastening means 4 placed on the two opposing sides thereof. The casing 3 is also capable of being removed and replaced according to the embodiment illustrated in FIGS. 4 and 5 by means of a zip fastener 3*a* or the like.

Referring to FIG. 6, there is seen a bookcase constructed of wall elements according to the aforedescribed embodiments. Thus, the rear portion of the bookcase comprises crossed support bars 5, 6. The end walls of the bookcase comprise wall elements of the embodiment shown in FIG. 1, the shelves 7*a*, 7*e* of the bookcase co-acting with fastening means 4 attached to the portions 2*a*.

FIG. 9 shows an embodiment of a bookcase in which the rear portion thereof is formed from a wall element of the type shown in FIG. 4. The end walls 1 are formed from the wall element illustrated in FIG. 1, in a manner similar to that illustrated in FIG. 6. The wall portions and the rear piece are held together by means of fastening means for two adjacently located pegs 4 and by means of specially constructed bookcases shelves 7*a*–7*e* which are brought into co-action with the fastening means 4 mounted in the portions 2*a*.

Figure 12:
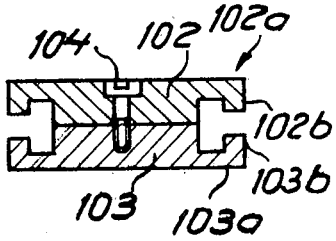
FIG. 12 shows a sectional side view of the basic principle of the element fastening device according to the present invention.

FIGS. 12–16 illustrate the principal application of the inventive concept and show side views of an element fastening device. The element has one or more fastening means, indicated by the reference numeral 101 arranged to co-act with the fastening device of the present invention to secure the element. The element may have the form of a wall section, the side member of a bookcase or like structure. The fastening means provided on the element has the form of a peg which has a narrow web or neck portion 101*b* located at a distance from the free end of the peg. The device according to the invention has at least two portions 102, 103, which are arranged to be moved towards and away from each other by means of a screw 104 or the like. At least one of said portions 102 has a recess 102*a* which is arranged to extend beyond the free end 101*a* of the peg 101 and is bent towards the narrow neck 101*b* of the peg. The downwardly bent portion has been indicated by the reference 102*b*. As illustrated in FIG. 12, the two portions 102 and 103 can be brought together by actuating the screw 104, in which position the peg 101 is clamped in the space formed by the outwardly projecting portion 102*a* and the downwardly bent portion 102*b*. In FIG. 12, the two portions 102, 103 are shown to be identical with one another, and thus the portion 103 also has an outwardly extending portion 103*a* and a bent portion 103*b*. When the two portions 102, 103 are brought together by means of the screw 104, the distance between the bent portions 102*b* and 103*b* will correspond to the dimension of the neck portion 101*b* of the peg.

The embodiment illustrated in FIG. 12 may be of circular or of regular polygonal shape. The outwardly projecting portions 102*b*, 103*b* are arranged at the periphery of portions 102 and 103 and with the illustrated embodiment the two portions have a circular peripheral surface.

With the embodiment illustrated in FIG. 13, one of said portions 102, consists of a tube 105, provided with a number of holes 105*a*, 105*b*. A plurality of holes 105*a* are positioned along a plane extending perpendicularly to the longitudinal direction of the tube 105. Thus the holes a are oriented in the same manner as the holes b. The holes 105*a*, however, are oriented in a plane different to that in which the holes 105*b* are oriented at a predetermined distance between said planes. The second portion 103, comprises a rod 106 arranged for insertion into the tube 105. The rod is provided with a number of outwardly projecting portions 107 located in the vicinity of the holes 105*a* in one and the same plane. The outwardly projecting portions 107 have the same configurations as the outwardly projecting portion described with reference to FIG. 12. Further, the outwardly projecting portions 107 are located in the vicinity of the inner surface of the tube. The upper portion of the tube 105 is provided with a cap 108 supporting a screw 109 or the like which is arranged to co-act with the rod 106 to enable the rod to be moved axially in the tube when the screw is turned. By means of this displacement of the rod, the projecting portion 107 can first be located at the side of the holes 105*a*, when the screw is moved to a first position, and is then moved to a position over the hole 105*a* when the screw 109 is moved to a second position. The first position is illustrated in FIG. 13 and the second position in FIG. 14. The length of the outwardly projecting portion 107 along the peg 101 and the wall thickness of the tube 105 coincides with or slightly exceeds the length of the neck portion 101*b*.

Figure 14:
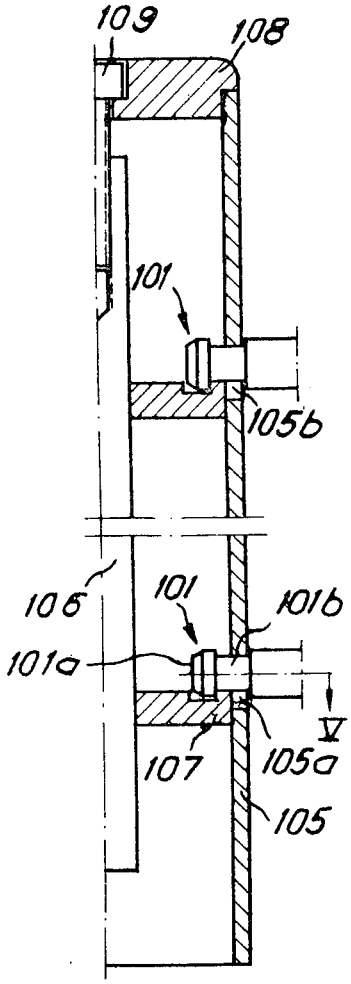
FIG. 14 is a view similar to that shown in FIG. 13, but with the elements retained by the element fastening device.
Figure 15:
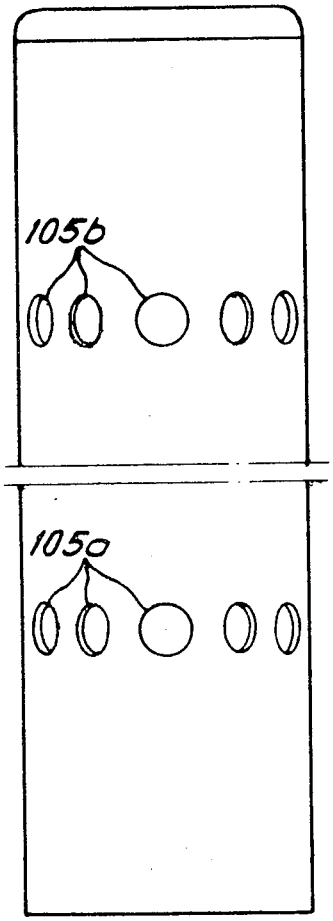
FIG. 15 shows an embodiment according to FIG. 13 a side view of the FIG. 14.
Figure 16:
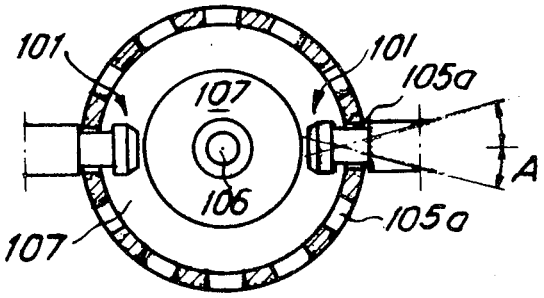
FIG. 16 is a sectional view through the device shown in FIGS. 13 and 14.

FIG. 16 is a plan section of the device shown in FIG. 13–15, taken on line V—V of both FIGS. 13 and 14. As will be seen from FIG. 16, owing to the shape of the hole 105*a* the peg 101 can be arranged at an angle to a diametrical line across the tube corresponding to A. Thus, the element can be arranged at any angle relative to the tubular post 105.

The mode of operation of the invention illustrated in FIGS. 13–16 is as follows. It is assumed that the outwardly projecting portion 107 has been moved to the position shown in FIG. 13 by activation of the screw 109. It is possible in this position to insert the element fastening means 101 through the holes 105*a*, 105*b*, whereupon the influence of the natural weight of the element the fastening means will fall down to engage the outwardly projecting portion 107. Thus, when this position is reached there is already a firm connection between the element and the outwardly projecting portion 107 or the post 105. Consequently, it is possible to adjust the position of the element relative to the tube 105 as required. The element can also readily be moved to an adjacent hole if necessary when fixing the wall elements or wall sections to the tube 105. Subsequent to positioning the wall sections or elements the screw 109 is turned so as to cause the rod 106 together with the projections 107 associated therewith to rise. This is illustrated in FIG. 14. In this way, the projection 107 will engage the element fastening means 101 which causes the element to lift together with the fastening means 101. Thus, when the element is lifted in this way it becomes firmly fixed to the tubular post 105 and it is no longer possible to move or change the position of the element relative to the tubular post 105 by simple means.

The invention is not restricted to the described and illustrated embodiments, but can be modified within the scope of the following claims.

I claim:

1. A wall element of generally planar configuration comprising a frame and a casing around said frame, a. said casing having a configuration similar to the configuration of the frame but exceeding the dimensions of said frame thereby leaving a space between said frame and casing, said casing forming the outer surface of the wall element;

b. stiffening means secured to said frame to stiffen said wall element;

c. a plurality of fastening means attached to said frame for securing said wall element to co-acting fastening means on a support, said fastening means being rigidly attached by one end thereof to said frame and having a free end opposite the attached end, some of said fastening means extending perpendicular to the plane of the wall element and others of said fastening means extending in the plane of the said wall element, each of said fastening means extending from the frame a distance such that the free end of such fastening means is located at least flush with the outer surface of the casing; and, d. a compressible material filling the space between the casing and the frame and displacibly covering the fastening means, said compressible material exposing said fastening means upon being compressed when said fastening means are secured to the co-acting fastening means on the support.

2. A wall element according to claim 1 wherein the casing of the wall element comprises a removable and replaceable protective member.

3. A wall element according to claim 2 wherein the casing member has a zipper fastener means arranged between two fastening means secured to said frame.

* * * * *